US005671864A

United States Patent [19]

Caruthers

[11] Patent Number: 5,671,864

[45] Date of Patent: Sep. 30, 1997

[54] NON-GRIP HOLDER FOR CONTAINERS

[75] Inventor: Scott Caruthers, Millersville, Md.

[73] Assignee: DAR Products Corporation, Baltimore, Md.

[21] Appl. No.: 493,785

[22] Filed: Jun. 22, 1995

[51] Int. Cl.[6] ..... B65D 23/10

[52] U.S. Cl. ..... 220/737; 220/771; 220/752; 220/772

[58] Field of Search ..... 220/758, 756, 220/755, 771, 752, 737, 772

[56] References Cited

U.S. PATENT DOCUMENTS

| | | | |
|---|---|---|---|
| D. 153,887 | 5/1949 | MacAulay | 220/771 |
| 2,586,199 | 2/1952 | Backus | 220/755 |
| 3,198,377 | 8/1965 | Buckley | 220/771 |
| 4,165,896 | 8/1979 | Hunt | 294/25 |
| 4,523,781 | 6/1985 | Brody | 294/1.1 |
| 4,602,885 | 7/1986 | Bischoff et al. | 401/6 |
| 4,606,484 | 8/1986 | Winter et al. | 224/218 |
| 4,909,392 | 3/1990 | Williams et al. | 220/756 |
| 5,076,438 | 12/1991 | Aronson | 220/771 |
| 5,199,587 | 4/1993 | Ota et al. | 220/755 |
| 5,207,338 | 5/1993 | Sandhu | 220/771 |
| 5,353,952 | 10/1994 | Donche | 220/755 |

*Primary Examiner*—Joseph M. Moy
*Attorney, Agent, or Firm*—Leonard Bloom

[57] ABSTRACT

A holder for a container which is attached to the side of the container. The holder has an outer wall and an inner wall defining a chamber therebetween with an opening to the chamber. The user's hand is inserted in the opening such that a forceful grip is not required to pick up and hold the container. The holder is electromagnetically welded or otherwise joined to the container. The holder is formed on a zarf. A two handed holder for the container permits both hands of the user to hold the container with a forceful grip not required.

19 Claims, 14 Drawing Sheets

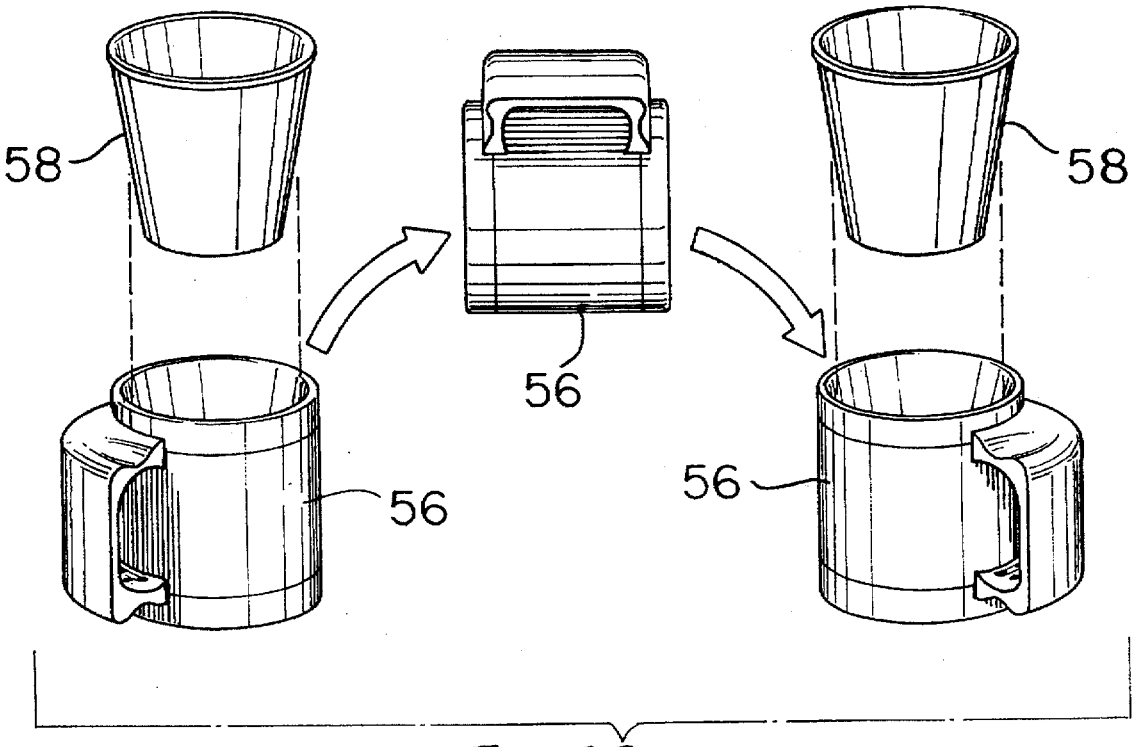
Fig. 22
Fig. 23
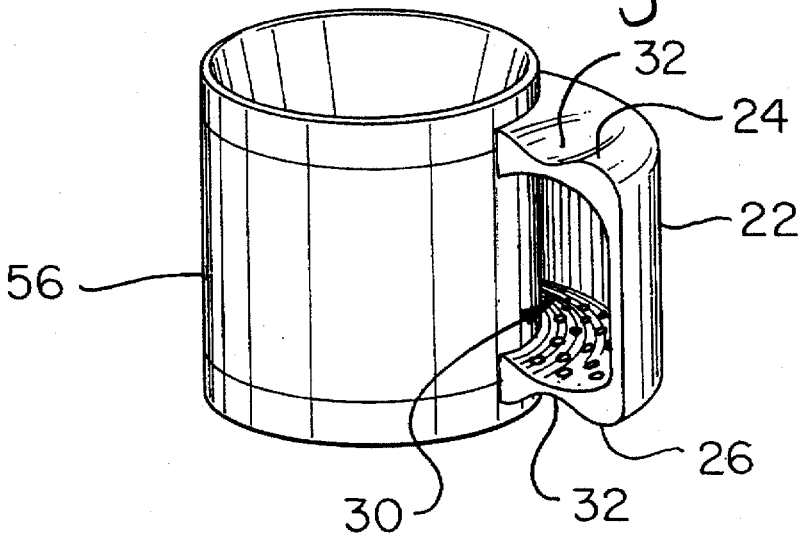

NON-GRIP HOLDER FOR CONTAINERS

FIELD OF THE INVENTION

The present invention relates to a container having a holder and to a holder for a container and, in particular, to a holder in which the user's hand is disposed such that a forceful grip is not necessary to pick up and hold the container.

BACKGROUND ART

The cup or pitcher having an ear-like handle is widely known and used. The handle is usually grasped with several of the user's fingers being inserted into the opening between the cup and the handle so that the handle is adjacent to the palm of the user's hand and the user's fingers grip the handle. Persons with arthritic conditions, or other manual disablements which reduce the dexterity of their fingers, have difficulties picking up and holding a cup full of liquid. This problem is exacerbated if the cup contains a hot liquid which, if spilled, could cause injuries to the user. Persons without any physical problems have difficulties picking up larger containers such as the common pitcher containing a quart of liquid. Frequently, pouring cannot be accomplished with one hand and two hands are required.

The applicant is aware of devices which have been proposed to assist persons with manual disablements as follows:

| U.S. Pat. No. | Inventor(s) |
|---|---|
| 4,165,896 | Hunt |
| 4,523,781 | Brody |
| 4,602,885 | Bischoff et al |
| 4,606,484 | Winter et al |

However, all of these devices are directed to an attachment to the hand of the user rather than to the container or object to be held or manipulated.

The present invention is also useful for persons who do not have disablements. The only devices of which the applicant is aware which are directed to non-grip holding are the following U.S. Pat. Nos. 4,813,669; 4,880,228; 4,896,880; 4,900,016; 5,139,472; 5,302,165; 5,342,268; 5,346,450; and application Ser. No. 08/203,015, all of which are inventions of the applicant and are directed to exercise devices. U.S. Pat. No. 5,009,416 issued to Caruthers discloses a grip facilitating handle for equipment including exercise devices, crutches, power tools, hand tools, motorcycles, and microprocessor controls and is especially useful in reducing fatigue associated with manipulation or control of the equipment, apparatus. The handle can be used as a retrofit for existing equipment.

However, none of the known handles or devices have been suggested for use with a container such as an ordinary cup, mug or pitcher, which are in everyday use. A need exists for a simple, energy efficient holder for a container of this type.

SUMMARY OF THE INVENTION

It is a primary object of the present invention to provide a holder for a container wherein a user may pick up and hold the container by inserting a hand within the holder without gripping the container.

It is another object of the present invention to provide a method for forming a container which the user can hold without gripping the container.

In accordance with the teachings of the present invention, there is disclosed herein a holder for a container to enable the container to be picked up and held by a hand of a user. The holder is on the container. The holder has an outer wall disposed radially of an inner wall and forming an opening therebetween. The inner wall has a convex outer surface and the outer wall has a concave inner surface. When the user's hand is inserted in the opening, the user's hand is substantially in a curved, natural, at rest position, around the inner wall and is disposed between the inner wall and the outer wall such that human effort is reduced and a forceful grip is not necessary to pick up and hold the container. The outer wall joins the inner wall at a point distal from the opening. The outer wall has a top portion adjacent to the container, the top portion being supported by the fore finger of the user.

In further accordance with the teachings of the present invention, there is disclosed a microwavable liquid container comprising a molded plastic generally-cylindrical main body having top and bottom portions, respectively. A non-grip molded-plastic handle having top and bottom portions, respectively is joined by an intermediate portion extending radially outwardly therefrom. The intermediate portion includes an outer wall. The respective top portions of the main body and the non-grip handle, and the respective bottom portions of the main body and the non-grip handle are aligned longitudinally of the container and electromagnetically welded together using respective rings disposed between the respective top portions and the respective bottom portions. The outer wall of the intermediate portion of the non-grip handle and the generally-cylindrical main body define a chamber therebetween for receipt of a person's hand, such that the container may be held conveniently without the necessity for a conventional handle affixed thereon nor for rigidly gripping the container.

In another aspect, the holder is formed on a zarf.

In still another aspect, a two handled holder is disclosed which permits the user to hold the container with both hands with a forceful grip not being required.

In still further accordance with the teachings of the present invention, there is disclosed a container for liquid to be held by a hand of a user such that a forceful grip is not necessary to pick up and hold the container. The method includes the steps of forming a cylinder having a height, an upper end, and a lower end. A curved U-shaped channel is formed having a first end, a second end, a base, an upper leg and a lower leg. The channel is tapered from the second end toward the first end. An open ring member is connected to the upper leg and a base member is connected to the lower leg such that the open ring member is disposed immediately above and coaxial with the base member. The open ring member is spaced apart from the base member by a distance approximately equal to the height of the cylinder. The cylinder is placed between the open ring member and the base member, with the open upper end of the cylinder adjacent to and cooperating with the open ring member and the lower end of the cylinder adjacent to the base member. The channel extends partially around the cylinder. Magnetically active material is placed between the upper end of the cylinder and the open ring member and between the lower end of the cylinder and the base member. The cylinder and channel are joined in a fixture. The cylinder is electromagnetically welded to the open ring member and base member of the channel thereby forming an integral unit having a cylindrical body. The second end of the tapered U channel is disposed near the cylinder. The first end of the tapered U channel forms an opening with the cylinder wherein the user's hand is inserted in the opening and received between the wall of the cylinder and the base of the U channel such that the container is picked up and held without the forceful grip.

These and other objects of the present invention will become apparent from a reading of the following specification, taken in conjunction with the enclosed drawings.

BRIEF DESCRIPTION OF THE DRAWINGS

FIG. 22 is a sequence of perspective views showing a zarf having a holder of the present invention formed thereon such that the zarf may be held by either hand of the user by inversion of the zarf, and showing the receiving of the container in the zarf before and after inversion.

FIG. 23 is a perspective view of the zarf showing the opening to the holder.

DESCRIPTION OF THE PREFERRED EMBODIMENTS

Figure 1:
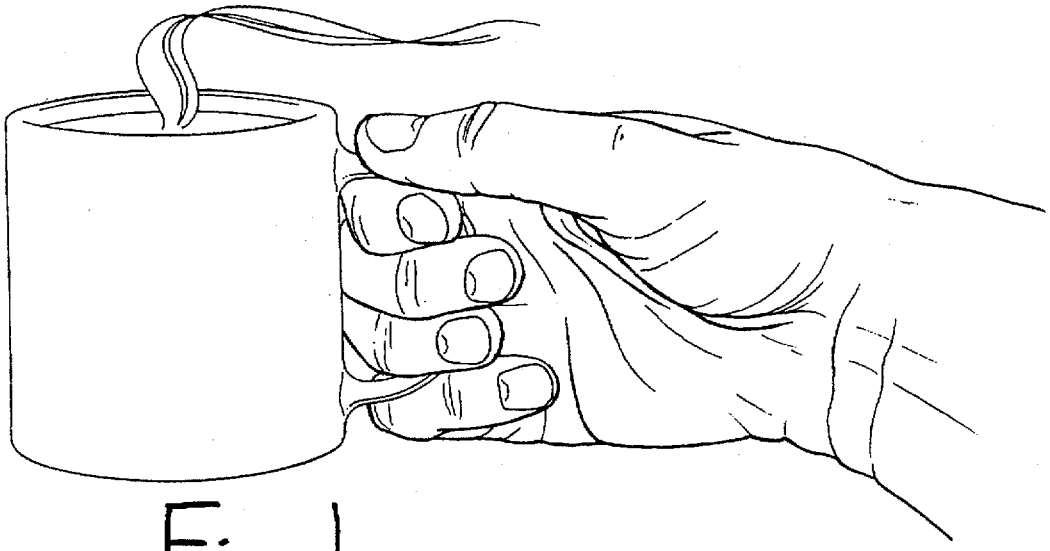
Fig. 1 Prior Art
FIG. 1 is a pictorial view of the prior art showing the handle of the cup in the grasp of the user's hand.
Figure 2:
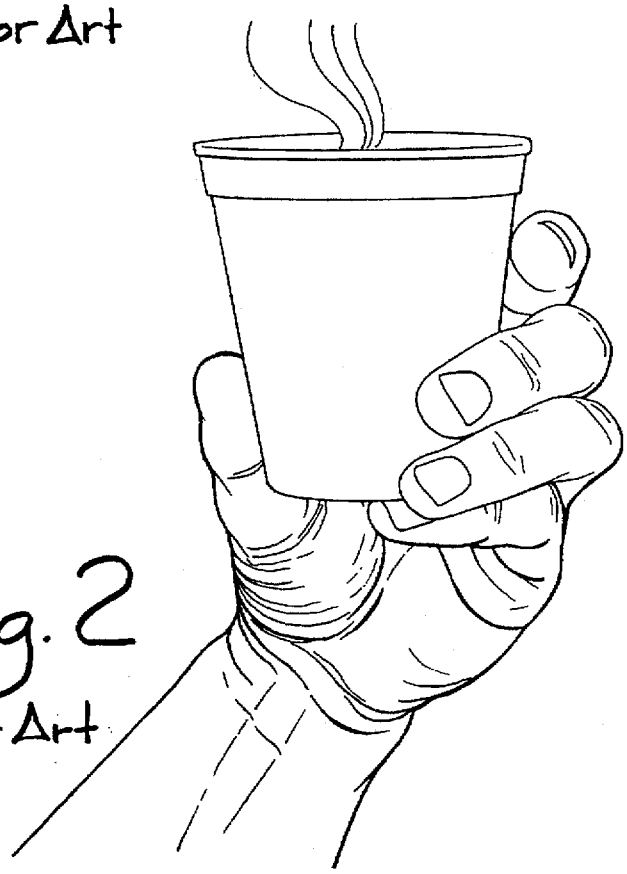
Fig. 2 Prior Art
FIG. 2 is a pictorial view of the prior art showing the tapered cup without a handle grasped in the user's hand.
Figure 3:
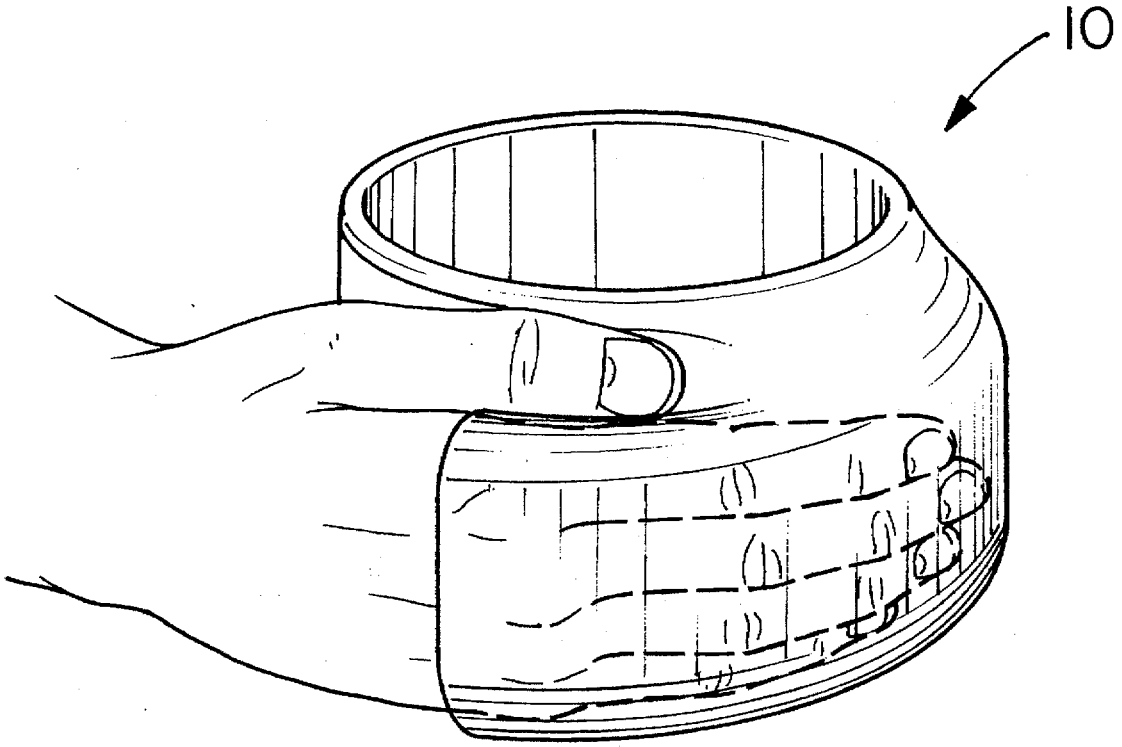
FIG. 3 is a pictorial view of the present invention being held without a forceful grip by a user.

Referring now to the prior art as shown in FIGS. 1 and 2, a container for liquid, such as a cup is held by the user with several of the user's digits inserted through the opening between the ear on the cup and the container portion of the cup. The ear of the cup is grasped between the digits and the palm of the hand with the remaining digits clenched against the palm of the hand. Those containers without an ear are gripped between the digits of the user's hand which encircle the container and squeeze the container against the palm of the user's hand. Generally, the container without an ear is wider at the top and narrower at the bottom to facilitate the user's grip and to reduce the possibility of spilling the liquid contents of the container.

The container having the holder of the present invention does not require a forceful grip but rather is held with minimal expenditure of energy and effort while maintaining complete control of the container with liquid contents therein (FIGS. 3–10). In a preferred embodiment, the container 10 has a cylindrical body 12 although the top 14 of the body 12 may be slightly wider than the bottom 16 of the body 12. The outer surface 18 of the body 12 is convex and serves as the inner wall of the holder as will be described.

An outer wall 20 of the holder is disposed radially of the outer wall of the body 12. The outer wall 20 of the holder is substantially a U-shaped channel with a base 22, an upper leg 24 and a lower leg 26. The legs 24, 26 are joined to the respective top and bottom ends of the body 12. The outer wall 20 of the holder (the U-shaped channel) extends partially around the body 12. The base 22 at the first end 34 of the channel is spaced away from the outer surface 18 of the body 12 and forms an opening 28 between the outer surface 18 of body 12 and the outer wall 20 of the holder. As shown in FIGS. 4–11, the opening 28 has a face in a plane substantially perpendicular to the outer wall 20 of the holder. Preferably, the channel is tapered toward the second end 36 of the outer wall 20 distal from the opening 28 such that the upper leg 24 and the lower leg 26 become progressively shorter and; at the second end 36 of the channel, the legs 24, 26 no longer exist. Alternately, the upper leg 24 and the lower leg 26 may be substantially the same height except at the second end 36 of the outer wall 20 where the legs 24, 26 are shortened to terminate the outer wall 20 (the channel) substantially against the outer surface 18 of the body 12. In this manner, a chamber 30 is formed between the body 12 and the outer wall 20 of the holder which communicates with the opening 28. The user's hand is inserted into the opening 28 and into the chamber 30. The second end of the channel 20 is at a distance from the first end such that the chamber 30 is sufficiently large to accommodate the user's hand. When so inserted, the user's hand is substantially curved in a natural, at rest, position about the convex outer surface 18 of the body 12 (i.e., the inner wall of the holder) and is adjacent to the concave inner surface of the outer wall 20 of the holder. The palm of the user's hand rests on the convex outer surface 18 of the body 12 and the back of the user's hand confronts the concave inner surface of the outer wall 20 of the holder. The leading finger of the user's hand is in contact with the inner surface of the upper leg 24 and assists in supporting the holder on the user's hand. Any or all of the digits, except the thumb, of the hand of an average size user, are received in the opening 28. If desired, the thumb is comfortably disposed on the outer surface of the upper leg 24 of the channel 20 such that the thumb does not contact the contents of the container 10. It is preferred that a depression 32 be formed on the outer surface of the upper leg 24 at the first end of the channel 20, immediately adjacent to the opening 28. The thumb rests in the depression 32 to improve the comfort of holding the container 10 however, the container 10 may be comfortably held without the thumb resting in the depression 32. The user's hand is so disposed in a natural, at rest, position. With the user's hand inserted into the holder, human effort and energy is reduced and the user may pick up and hold the container 10 without gripping the container. When so held, the user can tilt the container to drink, or to pour liquid, from the container 10, still without gripping the container and with minimal expenditure of energy. The present invention can be used by persons whose digits are missing due to amputation or congenital reasons and also by persons whose digits are abnormal due to deformity, illness, etc.

Figure 4:
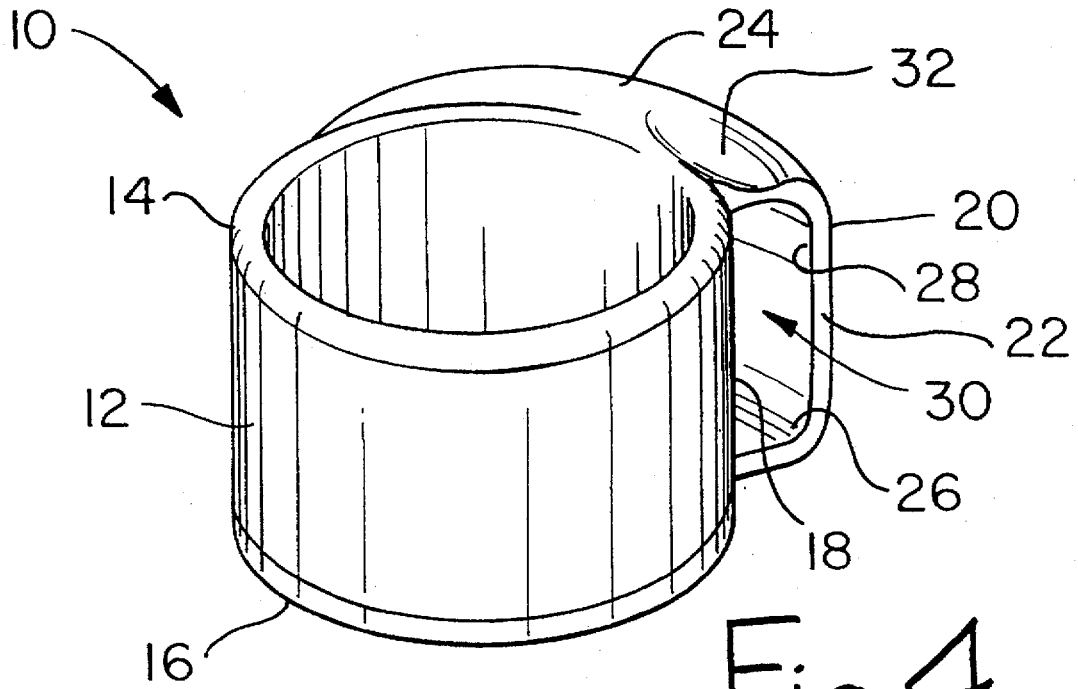
FIG. 4 is a perspective view of the present invention to be held by the right hand.
Figure 5:
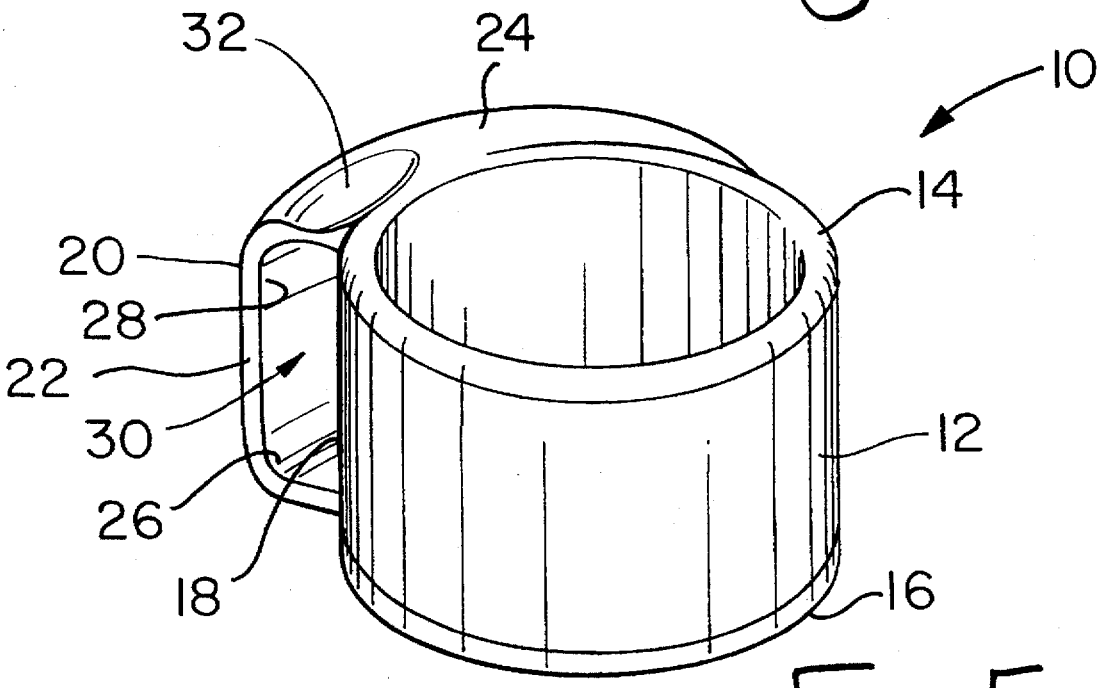
FIG. 5 is a perspective view of the present invention to be held by the left hand.
Figure 6:
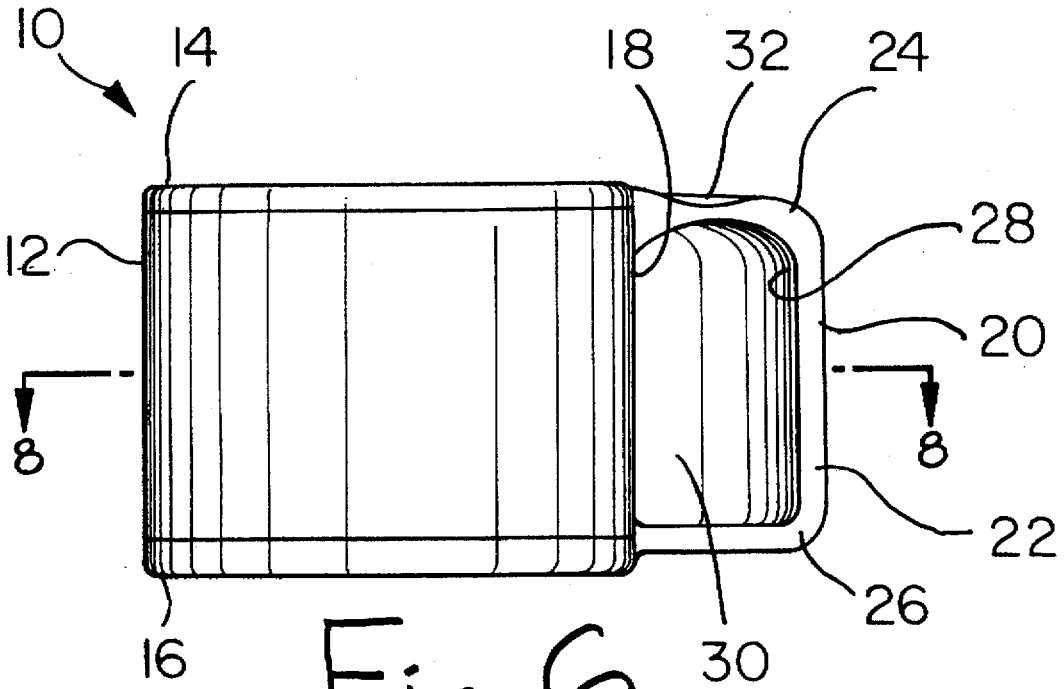
FIG. 6 is a front view of the present invention showing the opening into which the user's hand is inserted.
Figure 7:
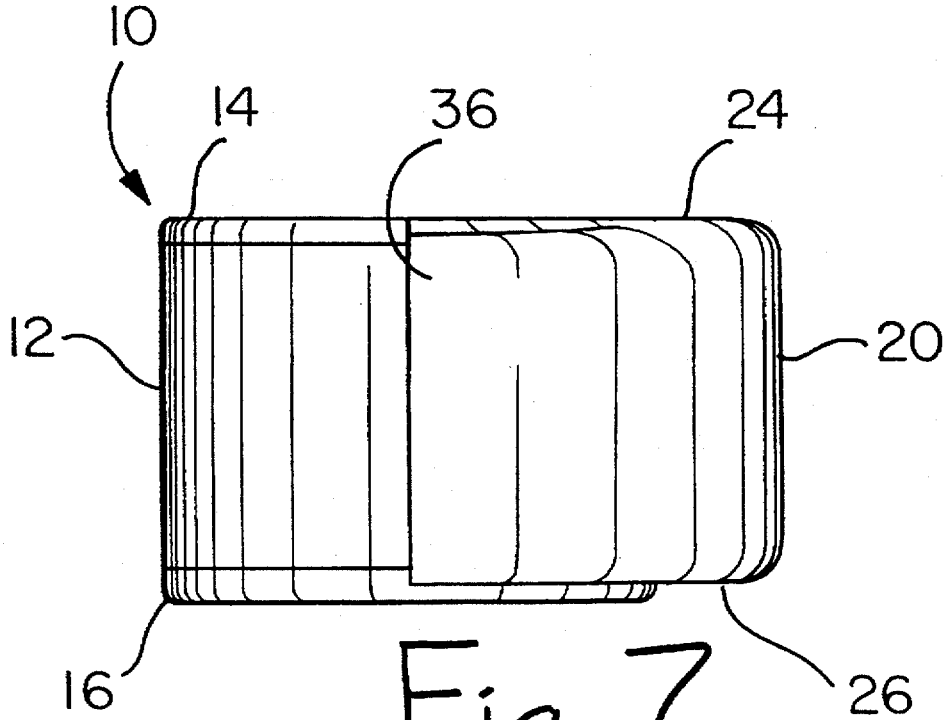
FIG. 7 is a rear view of the present invention.
Figure 8:
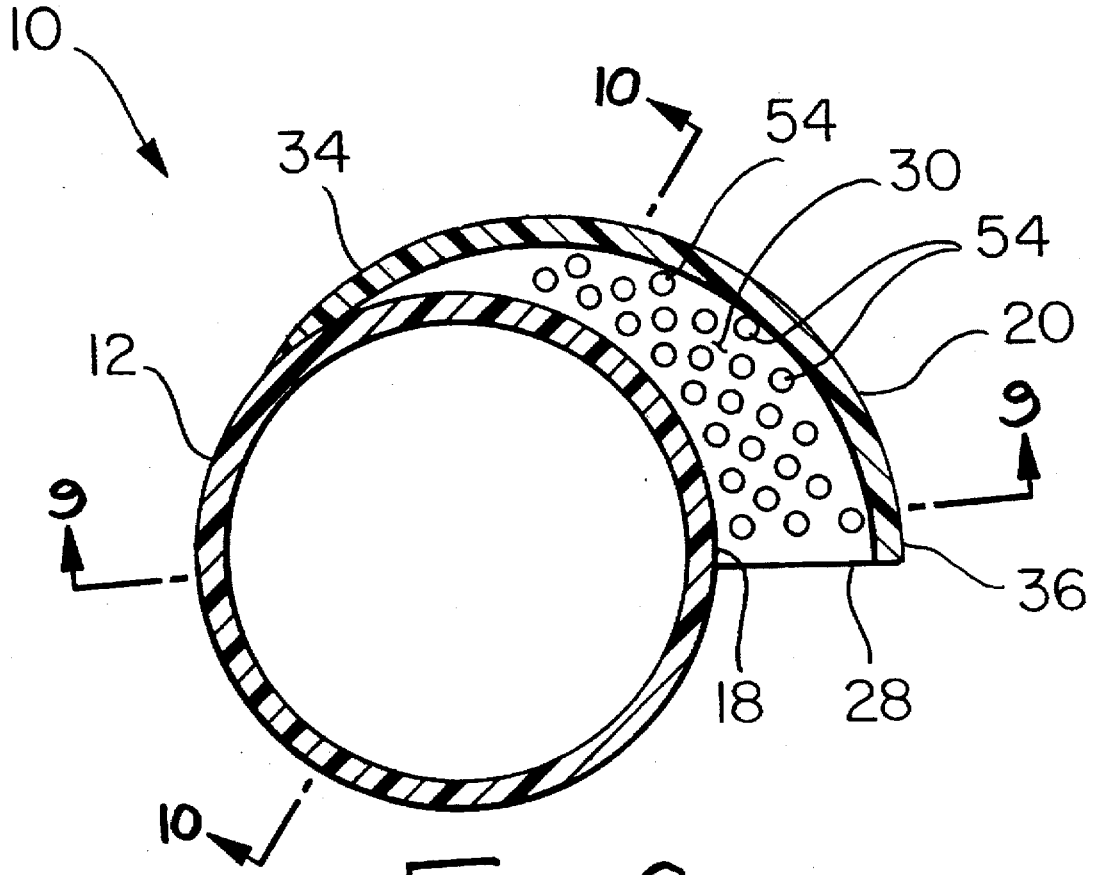
FIG. 8 is a cross-sectional view taken across the lines 8—8 of FIG. 7.
Figure 9:
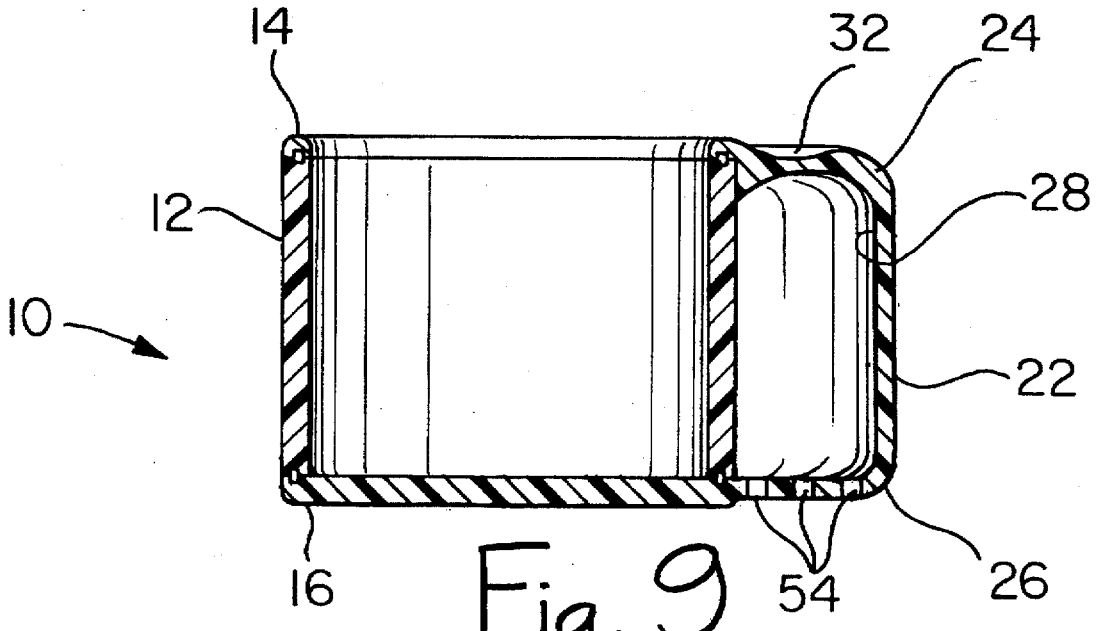
FIG. 9 is a cross-sectional view taken across the lines 9—9 of FIG. 8.
Figure 10:
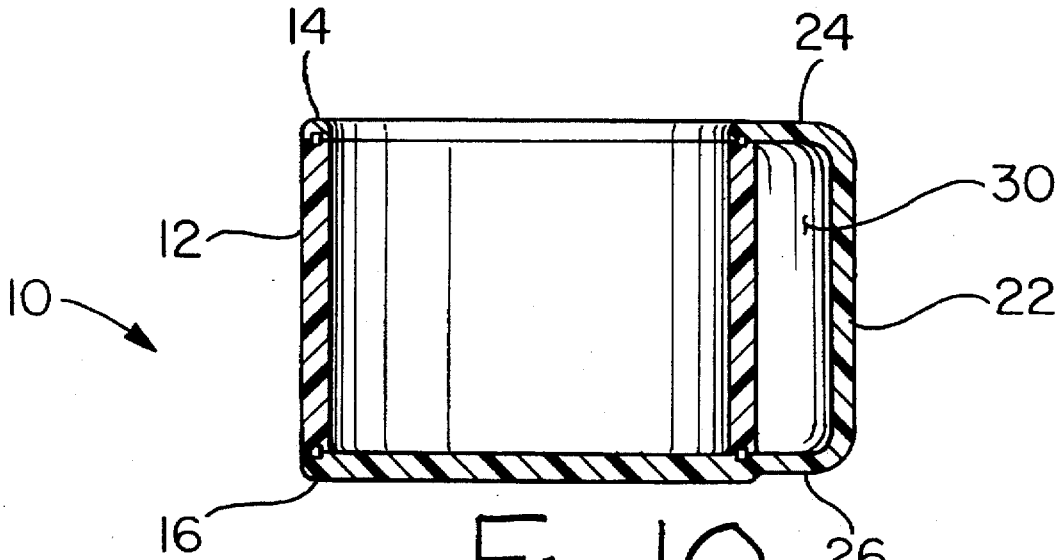
FIG. 10 is a cross-sectional view taken across the lines 10—10 of FIG. 8.
Figure 11:
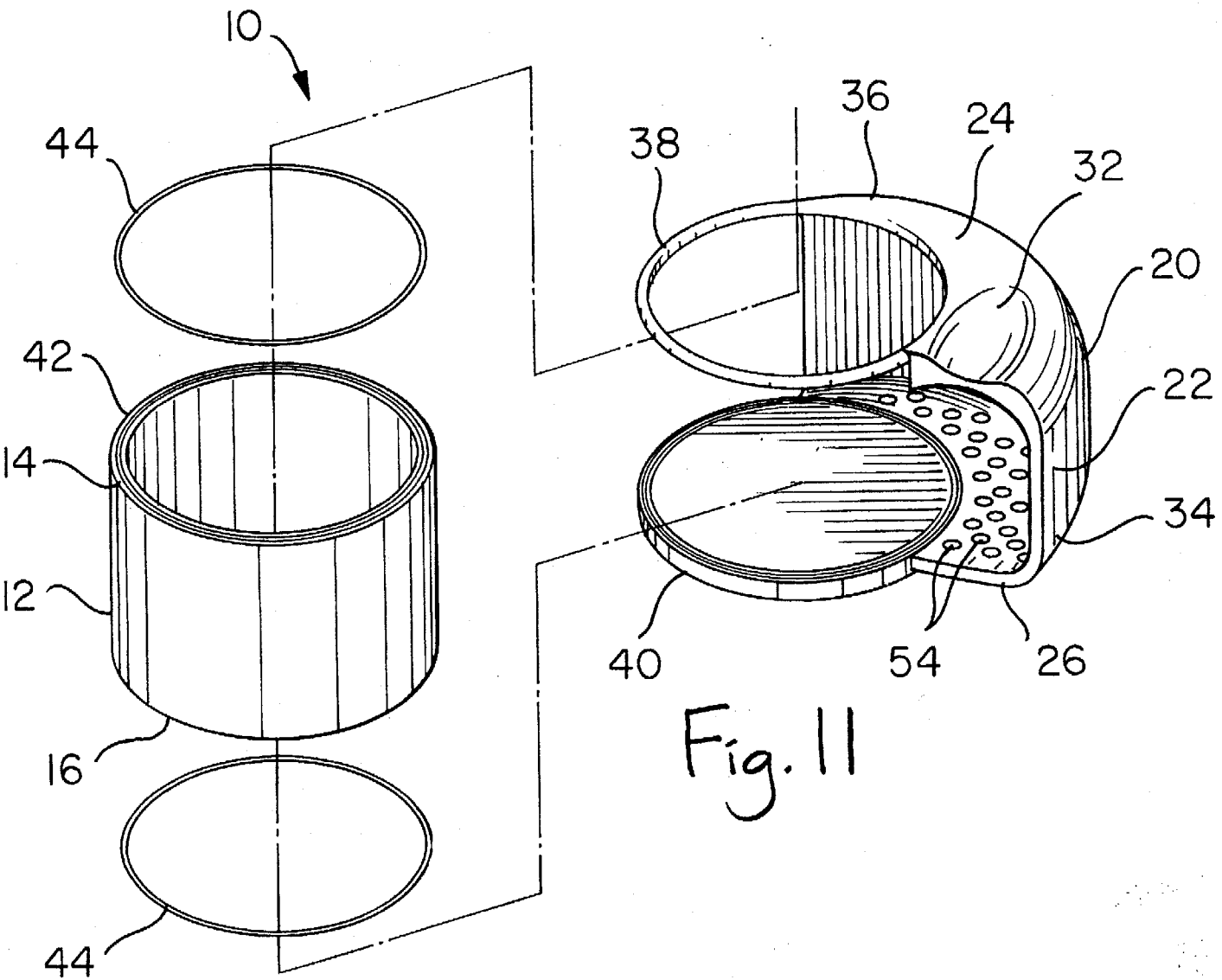
FIG. 11 is an exploded perspective view of the present invention.
Figure 12:
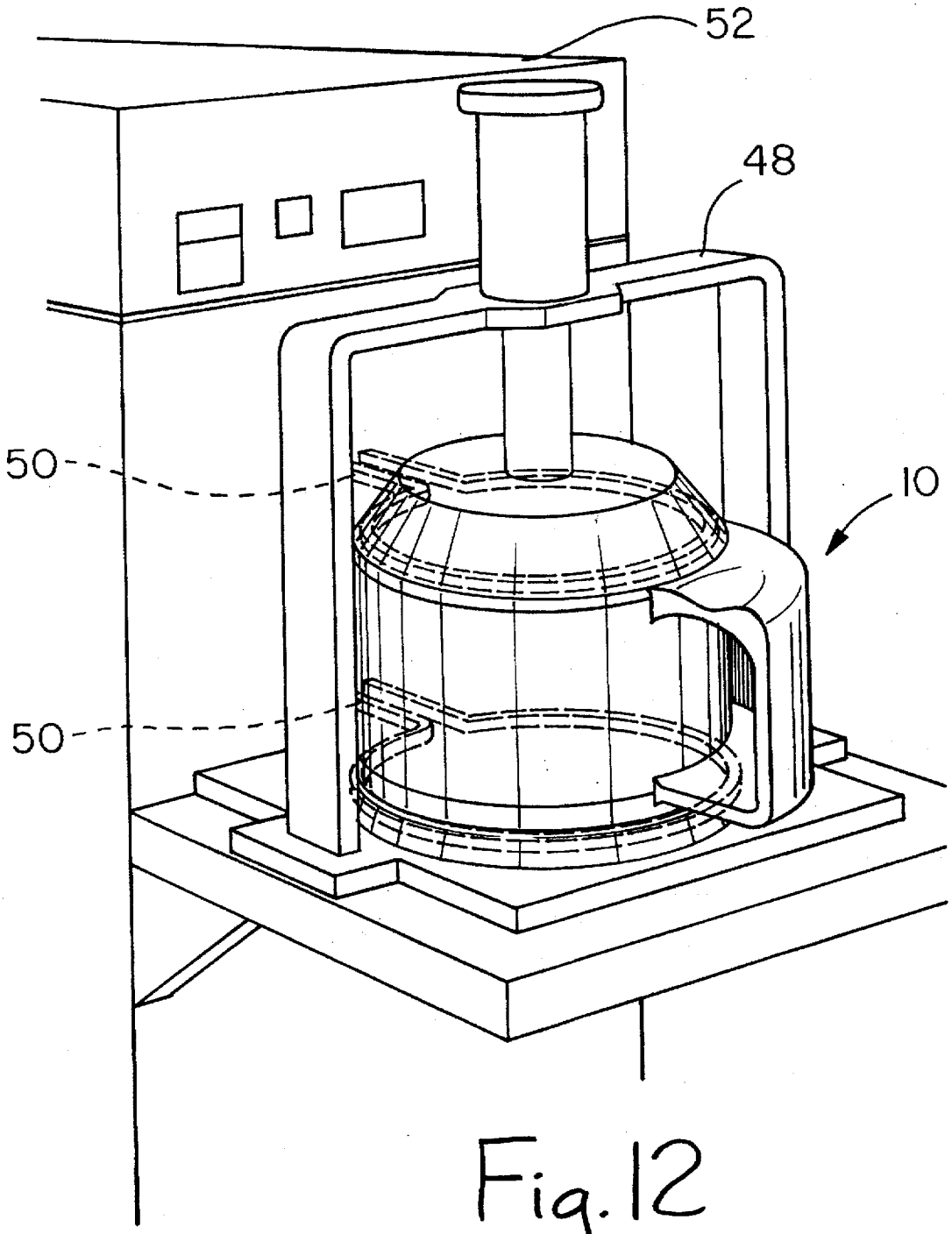
FIG. 12 is a perspective view of the present invention being held in a fixture for electromagnetically welding the components of the present invention.
Figures 13, 14, 15:
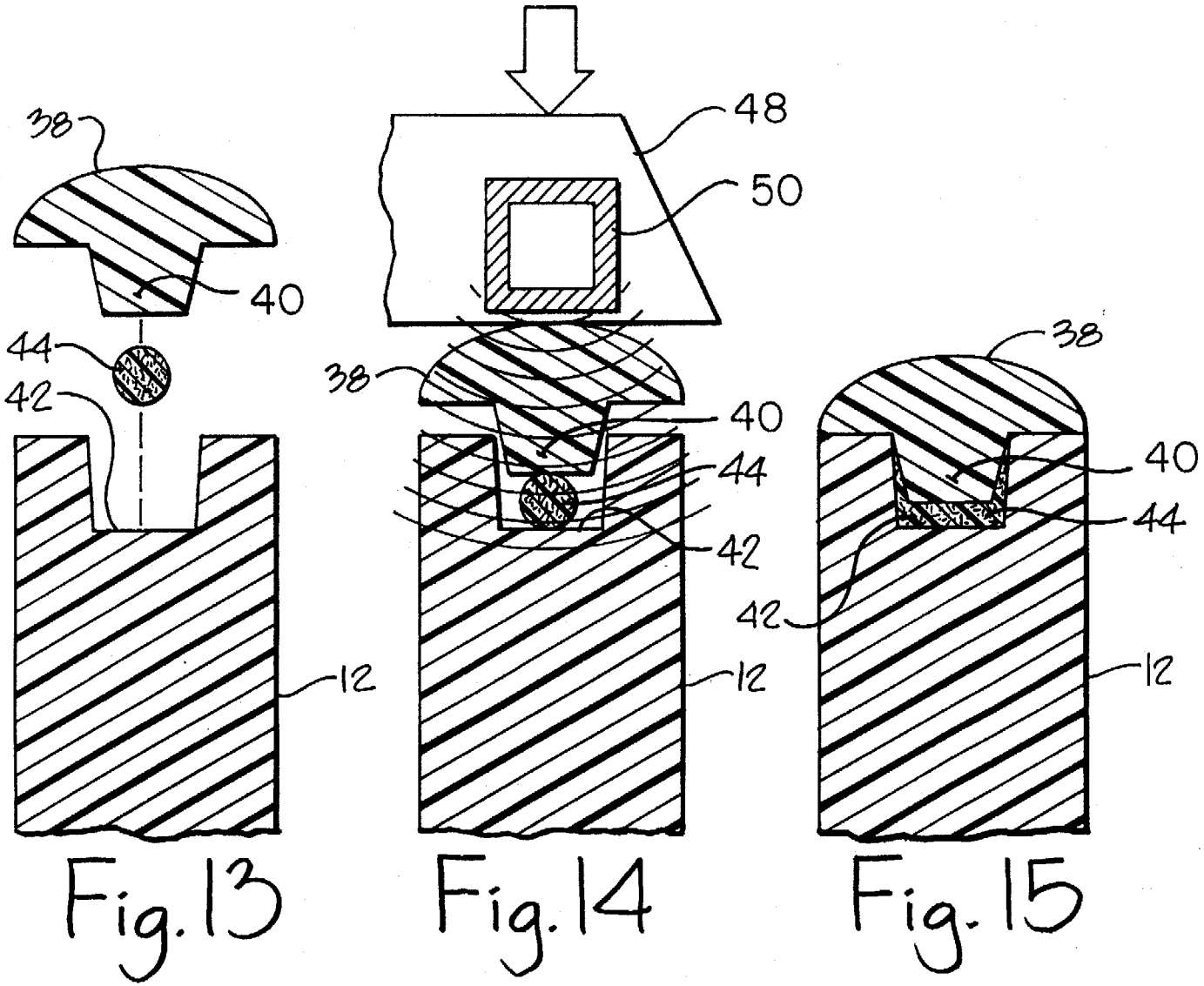
FIG. 13 is an enlarged cross-sectional view showing the disposition of the magnetically active material between the components of the present invention.
FIG. 14 is an enlarged cross-sectional view showing the present invention held in the fixture and the application of an electromagnetic field to the device.
FIG. 15 is an enlarged cross-sectional view of the electromagnetically welded interface between components of the present invention.
Figure 16:
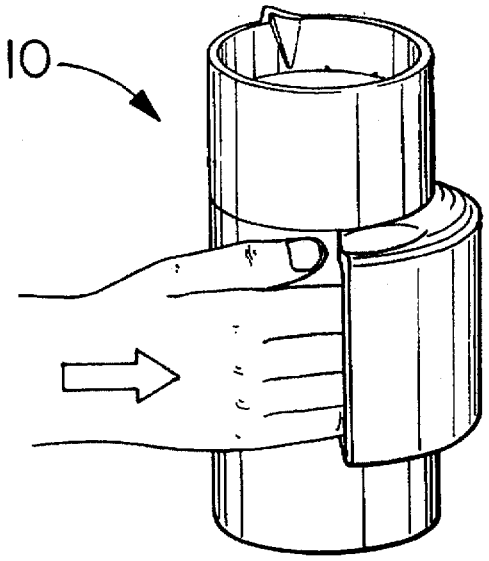
FIG. 16 is a perspective view of a user's hand being inserted into the opening of the holder of the present invention formed on a pitcher.
Figure 17:
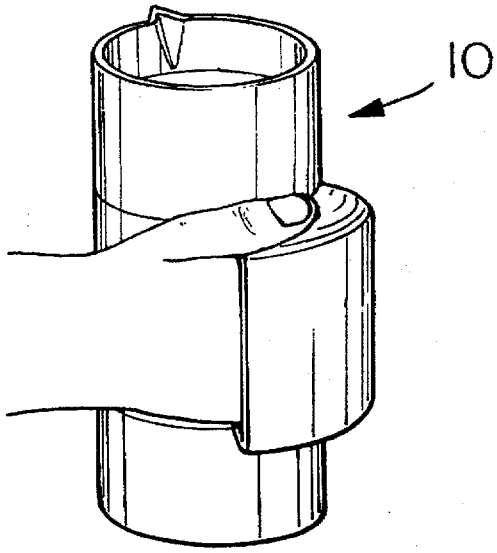
FIG. 17 is a perspective view of the pitcher of FIG. 16 being held by the user.
Figure 18:
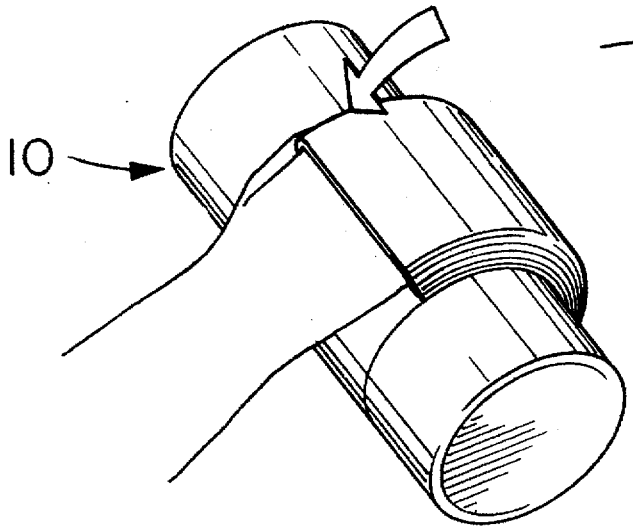
FIG. 18 is a perspective view of the pitcher of FIG. 16 being tilted for pouring.

The holder may be formed and connected to the container 10 such that the outer wall 20 extends in a counterclockwise direction from the opening 28 to accept the right hand of the user. Alternately, the holder may be formed and connected to the container 10 such that the outer wall 20 extends in a clockwise direction from the opening 28 to accept the left hand of the user (FIGS. 4 and 5).

The container 10 with the holder thereon may be formed from any type of material including ceramic, glass, metal and plastic and may be a cup, a mug, a beverage container, a coffee pot, a tea pot, a carafe, a measuring cup, a pitcher, a can or a bottle.

Referring now to FIGS. 11–15 a method of forming the container 10 from plastic is shown. A cylindrical body 10 is formed having an open upper end 14. The lower end 16 of the cylindrical body may be open or may be a bottom wall as will be described. A curved U-shaped channel 20 is formed having a base 22, an upper leg 24 and a lower leg 26. It is preferred that the legs 24, 26 are substantially perpendicular to the base 22. The lengths of the legs 24, 26 are greater near the first end 34 of the channel 20 than near the second end 36 of the channel such that the first end 34 of the channel is deeper than the second end 36 of the channel. An open ring member 38 is connected to the upper leg 24 of the channel 20 and is substantially in the same plane as the upper leg 24. A circular base member 40 is connected to the lower leg 26 of the channel 20 and is substantially in the same plane as the lower leg 26. The base member 40 is an open ring if the cylindrical body 20 has a bottom wall, and the lower member 40 is a solid disc if the cylindrical body 20 has an open lower end 16. In this manner, the cylindrical body 20 forms a container with a closed bottom and an open top as will be described. The diameter of the open ring member 38 and of the base member 40 are substantially equal to the diameter of the top end 14 of the body 12 and of the bottom end 16 of the body 12, respectively. The ring member 38 is disposed immediately above and coaxial with the base member 40. The open ring member 38 is spaced apart from the base member 40 by a distance approximately equal to the height of the cylindrical body 12.

Preferably a groove 42 is formed in the upper edge and in the lower edge of the cylindrical body 12. Alternately the groove 42 may be formed in the under side of the circumference of the ring member 38 and in the upper side of the circumference of the base member 40. In still another embodiment, a tongue is formed in the cylindrical body 12 or in the ring member 38 and base member 40 to be received in the opposing and corresponding groove 42. Magnetically active material 44 is placed in the respective grooves 42. This material 44 preferably has ferromagnetic particles in a thermoplastic mixture. The cylindrical body 12 is placed between the open ring member 38 and the base member 40 with the open upper end 14 of the body 12 adjacent to and cooperating with the open ring member 38 and the lower end 16 of the body 12 adjacent to the base member 40. The magnetically active material 44 is between the body 12 and the ring member 38 and base member 40 respectively. The body 12 and the channel 20 with the connected ring member 38 and base member 40 are disposed in a fixture 48 to join the components. Work coils 50 are placed near the interface between the body 12 and the members 38, 40 and energized by an induction generator 52 to produce an electromagnetic field to electromagnetically weld the body 12 to the members 38, 40 by fusing the magnetically active material 44 at the joint interface to produce a polymer to polymer linkage. The electromagnetic welding system marketed by Ashland Chemical Company under the trademark "EMA WELD" has been used successfully by the applicant. In this manner, a unitary container with holder is formed. The completed container with holder is microwavable, easily cleaned, lightweight and sturdy.

The electromagnetic welding method described herein may also be used to attach the holder to the side of a container such as a pitcher or zarf as shown in FIGS. 16–18 and 22–24.

Although electromagnetic welding is preferred, other methods known to persons skilled in the art, may be used to join the body to the holder. These include adhesives and mechanical means.

Alternately, the holder portion of the container may be formed to have a chamber 30 which has a greater width at the top than at the bottom. Thus, when the user's hand is inserted, the chamber 30 is wider to accommodate the portion of the hand nearer the thumb and narrower to receive the portion of the hand distal from the thumb. The user's hand may be disposed in the chamber 30 even if the hand is deformed or has missing digits.

A further feature of the holder is the inclusion of a drainage means 54 to facilitate washing and cleaning of the chamber 30. The drainage means may be an opening at the second end 36 of the channel 20 or a plurality of spaced-apart openings on the upper leg 24, the lower leg 26 or both legs 24, 26.

Figure 19:
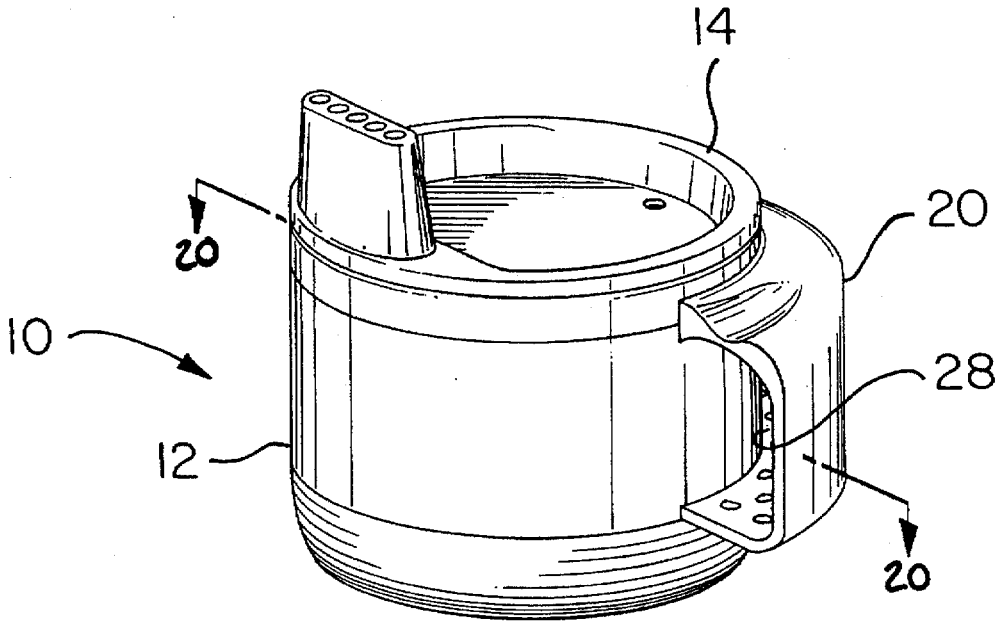
FIG. 19 is a perspective view of a child's drinking cup having two holders of the, present invention formed on the cup.
Figure 20:
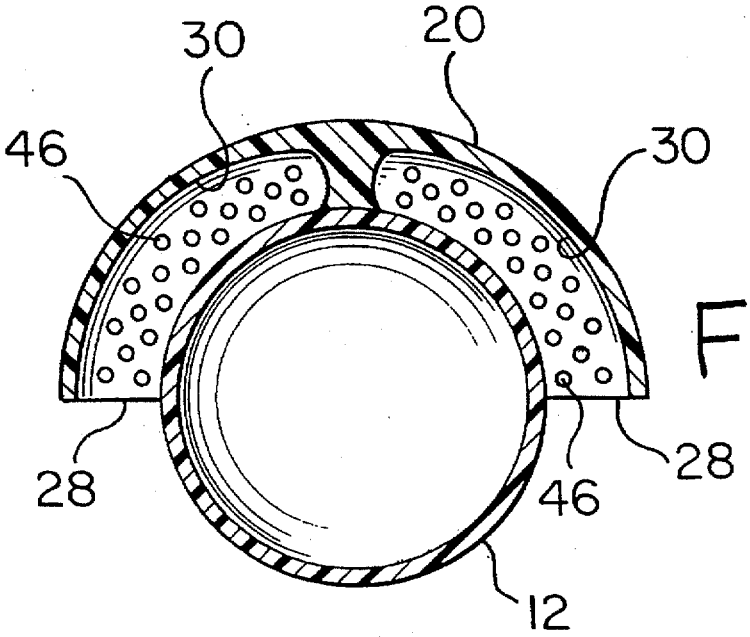
FIG. 20 is a cross-sectional view across the lines 20—20 of FIG. 19.
Figure 21:
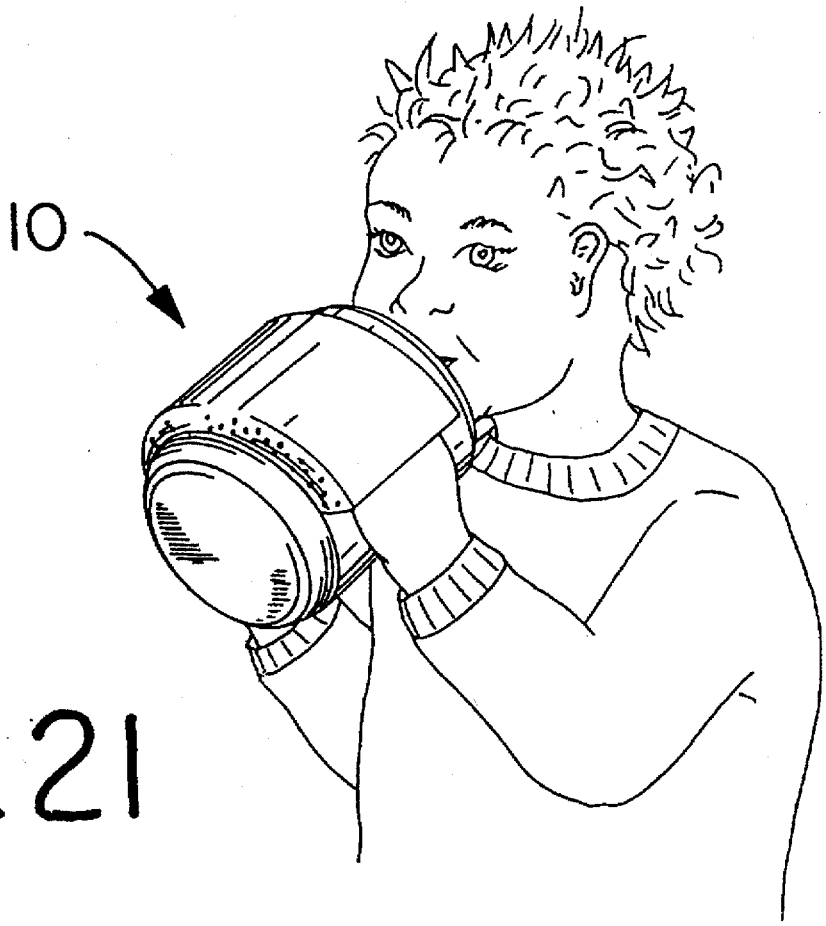
FIG. 21 is a pictorial view of a child holding and drinking from the cup of FIG. 19.

The holder may be a two-handed holder having at least one chamber 30 with two openings 28 (FIGS. 19–21). Each opening 28 communicates with the at least one chamber 30. If desired, the holder may be formed with two separate chambers 30, each chamber 30 communicating with a separate opening 28. The at least one chamber 30 (or the two separate chambers 30) is defined by an outer wall 20 and an inner wall 18 so that the user's hands may be disposed through the openings 28 and into the at least one chamber 30 (or two chambers) in a manner identical to the single-handed holder as previously described. Thus, the user can pick up the container with both hands or, if desired, with either hand. A forceful grip is not required with either or both hands to hold the container. This embodiment is of particular use by small children or by persons having disabilities or reduced strength in their hands.

Figure 24:
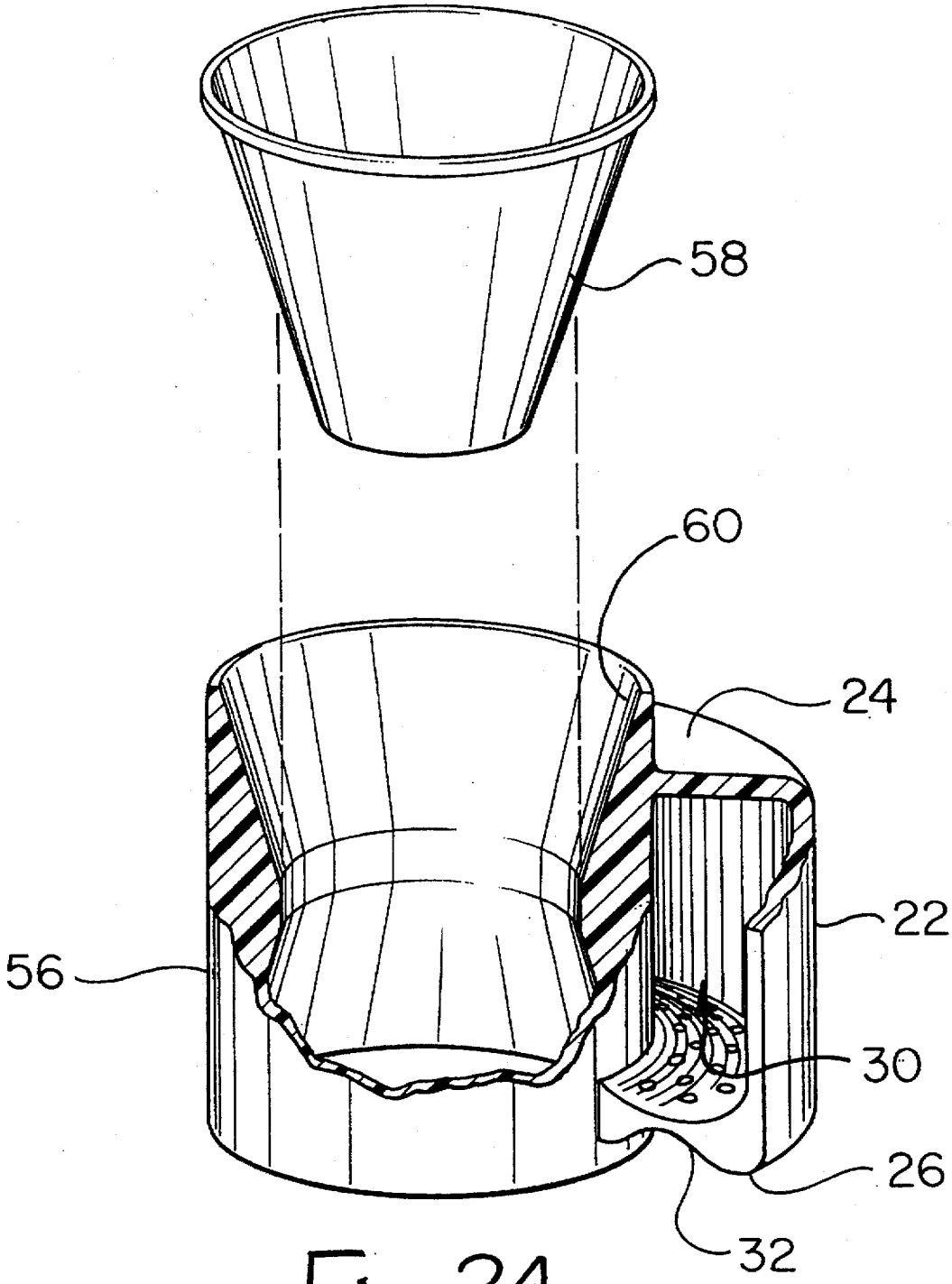
FIG. 24 is a partial cut-away perspective view of the zarf showing the holder and showing the tapered, internal wall of the zarf capable of receiving the container.

When attached to a zarf type of container 56, the holder facilitates use by either the left hand or the right hand of the user as shown in FIGS. 22–24. The left hand of the user may be inserted in the holder 11 with a replaceable container 58 for liquid held in the zarf 56 by conventional means.

Inversion of the zarf 56 permits the right hand of the user to be inserted in the same holder with the replaceable container 58 for liquid being held in the opposite side of the zarf 56. The holder on the zarf 56 is substantially the same as the holder for the container described previously which has the U-shaped channel, with a base, an upper leg and a lower leg, an opening, a chamber and drainage means.

The internal wall 60 of the zarf 56 is narrower in the center of the zarf 56 than it is at the outer edges and is tapered from the respective outer edges toward the center. In this manner, the replaceable container 58 may be inserted from either end of the zarf 56 and be retained in the zarf 48 because the diameter of the narrowest portion of the internal wall 60 of the zarf 48 is less than the diameter of an intermediate portion of the replaceable container 58. Thus, the replaceable container 58 is supported in the zarf 56 with a portion of the replaceable container 58 extending above the zarf 56 with the zarf 56 in either the inverted or the normal upright disposition. The holder preferably has a depression 32 formed on each of the opposite legs 24, 26 of the holder, wherein the thumb of the right hand and the left hand respectively, are received when the respective hand holds the zarf 56. A forceful grip is not necessary to pick up and hold the zarf 56.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A non-grip handle adapted to be attached to an outer wall of a container, the container to be held and controlled by the hand of a human user, the handle comprising:

an upper leg, a lower leg and a wall therebetween, the handle being disposed radially of the outer wall of the container, a chamber having an opening formed between the handle and the outer wall of the container, the chamber having dimensions to accommodate the hand of the user, the chamber being closed at a point distal from the opening, a depression being formed in the upper leg near the opening, whereby when the user's hand is inserted in the opening and received in the chamber, the user's hand is substantially in a natural, at rest, open position with the palm and the extended fingers of the user's hand being around the outer wall of the container and the user's thumb being supported in the depression such that a forceful grip is not necessary to pick up, hold and use the container.

2. The handle of claim 1, wherein the outer wall of the container joins the wall of the handle at the point distal from the opening, the handle having a height between the lower leg and the upper leg which is smaller than a distance from the opening to the distal point.

3. The handle of claim 1, further having drainage means formed in the lower leg of the handle to permit drainage of liquid from the handle.

4. The handle of claim 1, wherein the upper leg of the handle has a length whereby said upper leg is supported by the extended forefinger of the user's hand along an entire length of said forefinger.

5. The handle of claim 1, wherein the wall of the handle extends in a counterclockwise direction from the opening to accept the right hand of the user.

6. The handle of claim 1, wherein the wall of the handle extends in a clockwise direction from the opening to accept the left hand of the user.

7. The handle of claim 1, wherein the handle has two chambers extending around the outer wall of the container, each chamber having a respective opening, one chamber extending in a clockwise direction and the other chamber extending in a counterclockwise direction from the respective openings such that each chamber accepts a respective hand of the user.

8. The handle of claim 1, further comprising the legs of the handle being progressively shorter from the opening to the point distal from the opening such that the chamber is tapered toward the distal point.

9. The handle of claim 1, wherein the legs of the handle are perpendicular to the outer wall of the container forming a U-shaped cross-section, the opening having a face in a plane perpendicular to the outer wall of the container.

10. A non-grip handle adapted to be attached to an outer wall of a container, the container to be held and controlled by the hand of a human user, the container having an outer wall, the handle comprising:

an upper leg, a lower leg and a wall therebetween, the handle being disposed radially of the outer wall of the container, a chamber having an opening formed between the handle and the outer wall of the container, the chamber having dimensions to accommodate the hand of the user, the chamber being closed at a point distal from the opening, a plurality of spaced apart openings being formed in the lower leg of the handle to permit drainage of liquid from the handle, whereby, when the user's hand is inserted in the opening and received in the chamber, the user's hand is substantially in a natural, at rest, open position with the palm and the extended fingers of the user's hand being around the outer wall of the container such that a forceful grip is not necessary to pick up and hold the container.

11. The handle of claim 10, wherein the outer wall of the container joins the wall of the handle at the point distal from the opening, the handle having a height between the lower leg and the upper leg which is smaller than a distance from the opening to the distal point.

12. The handle of claim 10, wherein the upper leg of the handle has a length whereby said upper leg is supported by the extended forefinger of the user's hand along an entire length of said forefinger.

13. The handle of claim 10, wherein the wall of the handle extends in a counterclockwise direction from the opening to accept the right hand of the user.

14. The handle of claim 10, wherein the wall of the handle extends in a clockwise direction from the opening to accept the left hand of the user.

15. The handle of claim 10, wherein the handle has two chambers extending around the outer wall of the container, each chamber having a respective opening, one chamber extending in a clockwise direction and the other chamber extending in a counterclockwise direction from the respective openings such that each chamber accepts a respective hand of the user.

16. The handle of claim 10, further comprising the legs of the handle being progressively shorter from the opening to the point distal from the opening such that the chamber is tapered toward the distal point.

17. The handle of claim 10, wherein the legs of the handle are perpendicular to the outer wall of the container forming a U-shape cross-section, the opening having a face in a plane perpendicular to the outer wall of the container.

18. The handle of claim 10, further comprising a depression being formed in the upper leg near the opening such that the user's thumb is supported in the depression when the container is picked up, held and used by the user.

19. A non-grip handle adapted to be attached to an outer wall of a container, the container to be held and controlled by the hand of a human user, the container having an outer wall, the handle comprising:

an upper leg, a lower leg and a wall therebetween, the legs being perpendicular to the outer wall of the container forming a U-shaped cross-section, the handle being disposed radially of the outer wall of the container, a chamber having an opening formed between the handle and the outer wall of the container such that the opening has a face in a plane perpendicular to the outer wall of the container, the chamber having dimensions to accommodate the hand of the user, the chamber being closed at a point distal from the opening, a plurality of spaced-apart openings being formed in the lower leg of the handle to permit drainage of liquid from the handle, a depression being formed in the upper leg near the opening, whereby, when the user's hand is inserted in the opening and received in the chamber, the user's hand is substantially in a natural, at rest, open position with the palm and the extended fingers of the user's hand being around the outer wall of the container and the user's thumb being supported in the depression such that a forceful grip is not necessary to pick up, hold and use the container.

* * * * *